US006765457B2

(12) United States Patent
Tada et al.

(10) Patent No.: US 6,765,457 B2
(45) Date of Patent: Jul. 20, 2004

(54) DIELECTRIC FILTER, DIELECTRIC DUPLEXER, AND COMMUNICATION DEVICE HAVING ELONGATED THROUGH HOLES

(75) Inventors: Hitoshi Tada, Ishikawa-ken (JP); Yukihiro Kitaichi, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/160,337

(22) Filed: May 30, 2002

(65) Prior Publication Data

US 2002/0190821 A1 Dec. 19, 2002

(30) Foreign Application Priority Data

May 30, 2001 (JP) ..... 2001-162478
Apr. 9, 2002 (JP) ..... 2002-106994

(51) Int. Cl.[7] ..... H01P 1/202; H01P 1/213
(52) U.S. Cl. ..... 333/134; 333/206; 333/207
(58) Field of Search ..... 333/134, 202, 333/206, 207

(56) References Cited

U.S. PATENT DOCUMENTS 4,742,562 A * 5/1988 Kommrusch ..... 333/206
5,208,566 A * 5/1993 Kenoun et al. ..... 333/206
5,250,916 A * 10/1993 Zakman ..... 333/206
5,278,527 A * 1/1994 Kenoun et al. ..... 333/202
5,488,335 A * 1/1996 Agahi-Kesheh et al. .... 333/206
5,945,896 A * 8/1999 Miyamoto ..... 333/206
5,994,981 A * 11/1999 Toda et al. ..... 333/202

FOREIGN PATENT DOCUMENTS

EP 1067620 A2 * 1/2001 ..... H01P/1/205

* cited by examiner

*Primary Examiner*—Barbara Summons
(74) *Attorney, Agent, or Firm*—Dickstein, Shapiro, Morin & Oshinsky, LLP.

(57) ABSTRACT

A dielectric filter comprising a dielectric block having first and second opposed surfaces with a width direction and a length direction greater than the width direction. At least three conductive through holes are arrayed in the dielectric block in the length direction. In one embodiment, a sectional shape of at least one conductive through hole located between two other conductive through holes of the at least three conductive through holes is elongated in the width direction. In another embodiment, a sectional shape of two conductive through holes on either side of a third conductive through hole of the at least three conductive through holes is elongated in the width direction. With these arrangements, the jumping coupling capacitance is controlled.

18 Claims, 13 Drawing Sheets

DIELECTRIC FILTER, DIELECTRIC DUPLEXER, AND COMMUNICATION DEVICE HAVING ELONGATED THROUGH HOLES

BACKGROUND OF THE INVENTION

1. Field of the Invention

The present invention relates to a dielectric filter and a dielectric duplexer in which conductive through holes are provided in a dielectric block and in which an external conductor is provided on exterior surfaces of the dielectric block. The present invention also relates to a communication device using the dielectric filter and the dielectric duplexer.

2. Description of the Related Art

A typical dielectric filter is described with reference to FIGS. 11A and 11B. FIG. 11A is a perspective view of the dielectric filter and FIG. 11B is a front plan view of an open circuited end of the dielectric filter.

In FIGS. 11A and 11B, a dielectric block 1, through holes 2*a* to 2*c* with internal conductors 3*a* to 3*c*, an external conductor 4, conductor-free portions 5, input-output electrodes 6, and internal-conductor-free portions 7*a* to 7*c* are shown.

Preferably, the dielectric block 1 is in the form of a substantially rectangular solid. The holes 2*a* to 2*c* pass through the dielectric block 1 from one surface 1*a* to the opposite surface 1*b*. On the inside surface of the conductive through holes 2*a* to 2*c*, the internal conductors 3*a* to 3*c* are formed, respectively, so as to form respective conductive through holes. The external conductor 4 is preferably formed substantially on the whole outside surface of the dielectric block 1. The internal-conductor-free portions 7*a* to 7*c* are provided on the inside surface of the conductive through holes 2*a* to 2*c* such that the internal conductors 3*a* to 3*c* are separated from the external conductor 4 and form open circuited ends. In other words, the conductor-free portions 7*a* to 7*c* of each conductive through hole capacitively couple the conductive through holes to the external conductor and form the open circuited ends thereof. The other ends of the conductive through holes are directly coupled to the external conductor 4 so as to form the short circuited ends. In this way, dielectric resonators are formed by the internal conductors 3*a* to 3*c*, the dielectric block 1, and the external conductor 4.

On the outside surface of the dielectric block 1, the input-output electrodes 6 are formed so as to extend from opposite end faces of the dielectric block 1. The input-output electrodes 6 are preferably provided at opposite sides of the arrangement of the conductive through holes and are separated from the external conductor 4 by the external-conductor-free portions 5.

In this way, a dielectric filter is formed by the input-output electrodes 6 and the three dielectric resonators.

However, there are the following problems in such a dielectric filter which are illustrated with reference to FIGS. 12A to 12C. FIG. 12A is an equivalent circuit diagram of a two-stage dielectric resonator, FIG. 12B shows the state of electric lines of force in even mode and in odd mode, and FIG. 12C is an equivalent circuit diagram of a two-stage dielectric resonator having a jumping coupling capacitance.

In an integral type dielectric filter composed of a plurality of resonators using a dielectric block, tip capacitance Cs is generated between an open end of the resonator and the external conductor as a grounding electrode shown in FIG. 12A.

The electric lines of force where the tip capacitance Cs is generated in even mode and in odd mode are shown in FIG. 12B. In even mode, the electric lines of force are generated between the resonators and the grounding electrode. In odd mode, a part of the electric lines of force is generated between the resonators. Therefore, the tip capacitance Cs generated between the resonators and the grounding electrode in odd mode becomes smaller than that in even mode, and jumping tip capacitance dCs is generated between the open ends of the resonators. Here, since Cs is set on the basis of the capacitance in even mode, the jumping coupling capacitance dCs has a minus value.

In this way, when the jumping coupling capacitance dCs generated between the open ends of the resonators is considered, the equivalent circuit diagram shown in FIG. 12A becomes the circuit diagram in FIG. 12C.

A three-stage dielectric resonator is described with reference to FIGS. 13A and 13B. FIG. 13A is an equivalent circuit diagram of the three-stage dielectric resonator and FIG. 13B shows the attenuation characteristics of a dielectric filter provided with the three-stage dielectric resonator.

As shown in FIG. 13A, the tip capacitance Cs is generated between the open end and the external conductor as the grounding electrode in each resonator, and jumping coupling capacitance dCs1 is generated between the open ends of neighboring resonators, respectively. Furthermore, jumping coupling capacitance dCs2, which is very small compared to the jumping coupling capacitance dCs1 generated between the open ends of neighboring resonators, is also generated between the open ends of the non-neighboring resonators at both ends of the array of resonators.

Here, since the jumping coupling capacitance dCs1 generated between neighboring resonators is included in the coupling capacitance between resonators, the capacitance does not have great effects on the attenuation characteristics, but, since the jumping coupling capacitance Cs2 generated between the non-neighboring resonators is different from the coupling capacitance between resonators, the capacitance has an effect on the position of the attenuation poles as shown in FIG. 13B. For example, in a dielectric filter composed of a three-stage resonator in which they have combined (inductive) coupling, two attenuation poles are created on the higher-frequency side of the passband If the jumping coupling capacitance dCs2 is large, the space between the attenuation poles increases and, if the jumping coupling capacitance dCs2 is small, the space between the attenuation poles decreases. Therefore, desired attenuation characteristics cannot be obtained outside the passband, although they are dependent on the position where the attenuation poles are generated.

In order to solve this problem, dielectric filters shown in FIGS. 14A and 14B have been used.

FIGS. 14A and 14*b* are perspective views of dielectric filters.

In the dielectric filter shown in FIG. 14A, the inner diameter of the conductive through hole 2*b* is larger than those of the other conductive through holes 2*a* and 2*c*. In the dielectric filter shown in FIG. 14B, the inner diameter of the conductive through hole 2*b* is smaller than those of the other conductive through holes 2*a* and 2*c*.

In the dielectric filter shown in FIG. 14A, since the inner diameter of the conductive through hole 2*b* is large, the space between the internal conductor 3*b* and the external conductor 4 becomes smaller and the jumping coupling capacitance dCs2 generated between the internal conductor 3*a* and the internal conductor 3*c* decreases. Since the inner diameter of the conductive through hole 2*b* is not appropriate for obtaining the optimum Q0, Q0 of the resonators becomes smaller and adverse effects are added, such as insertion loss.

In the dielectric filter shown in FIG. 14B, since the inner diameter of the conductive through hole 2*b* is small, the space between the internal conductor 3*b* band the external conductor 4 becomes larger and the jumping coupling capacitance dCs2 generated between the internal conductor 3*a* and the internal conductor 3*c* increases. Since the inner diameter of the conductive through hole 2*b* is not appropriate for obtaining the optimum Q0, Q0 of the resonators also becomes smaller in this case and adverse effects are produced, such as insertion loss.

SUMMARY OF THE INVENTION

Accordingly, it is an object of the present invention to provide a dielectric filter and dielectric duplexer in which the deterioration of Q0 of resonators is suppressed, jumping coupling capacitance generated between non-neighboring resonators is controlled, attenuation poles are established at desired locations, and the attenuation characteristics are improved outside the passband. It is also an object to provide a communication device having the dielectric filter or the dielectric duplexer of the present invention.

In accordance with a first embodiment of the present invention, a dielectric filter includes a dielectric block having first and second opposed surfaces, the first and second opposed surfaces having a width direction and a length direction greater than the width direction. An external conductor is formed on exterior surfaces of the dielectric block and at least three conductive through holes arrayed in the length direction extend from the first to the second surface of the dielectric block. Each conductive through hole has a short circuit end directly coupled to the external conductor and an open circuit end capacitively coupled to the external conductor. A sectional shape of at least one conductive through hole located between two other conductive through holes of the at least three conductive through holes is elongated in the width direction. With this, capacitance generated between the conductive through holes on both sides of the at least one conductive through hole is reduced, and attenuation pole frequencies are shifted so that the space between two attenuation poles due to the jumping coupling between the resonators of the two non-neighboring conductive through holes may be narrowed.

In a second embodiment, the dielectric filter includes a dielectric block having first and second opposed surfaces, the first and second opposed surfaces having a width direction and a length direction greater than the width direction. An external conductor is formed on exterior surfaces of the dielectric block and at least three conductive through holes arrayed in the length direction extend from the first to the second surface of the dielectric block. Each conductive through hole has a short circuit end directly coupled to the external conductor and an open circuit end capacitively coupled to the external conductor. A sectional shape of two conductive through holes on either side of a third conductive through hole of the at least three conductive through holes is elongated in the width direction. With this, capacitance generated between the two elongated conductive through holes is increased, and attenuation pole frequencies are shifted so that the space between two attenuation poles due to the jumping coupling between the resonators of the two non-neighboring conductive through holes may be widened.

In a further embodiment of the present invention, the dielectric filter is constructed such that the cross-sectional shape of all of the conductive through holes is elongated in the width direction of the dielectric block.

In another embodiment, the dielectric filter of the present invention is constructed such that the conductive through holes are stepped holes in which the inner diameter on the open circuited end is different from the inner diameter on the short-circuited end. It is preferred that the stepped through hole is the elongated through hole.

In still a further embodiment, the dielectric filter of the present invention is constructed such that the axial position of the stepped conductive through holes on the open circuited end is different from the axial position on the short circuited end.

In one aspect of the present invention, the above dielectric filter is used in a dielectric duplexer. In another aspect of the present invention, a communication device is formed using the above dielectric filter or the above dielectric duplexer.

The term "cross section" refers to a section of the conductive through holes taken perpendicular to the axial direction of the holes. Hereinafter, the cross-sectional shape of the internal conductors is referred to as the sectional shape.

DESCRIPTION OF THE PREFERRED EMBODIMENTS

Dielectric filters according to a first embodiment of the present invention are described with reference to FIGS. 1A to 3.

Figure 1A:
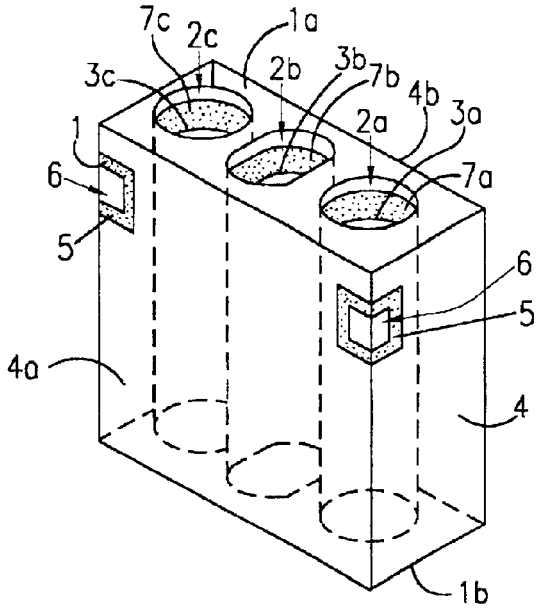
FIG. 1A is a perspective view of a dielectric filter according to a first embodiment of the present invention.
Figure 1B:
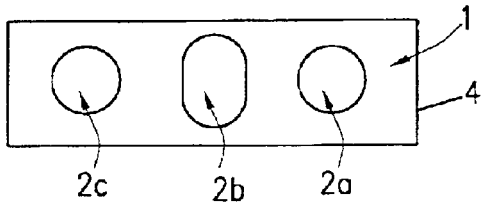
FIG. 1B is a top plan view of the dielectric filter of FIG. 1A.
Figure 1C:
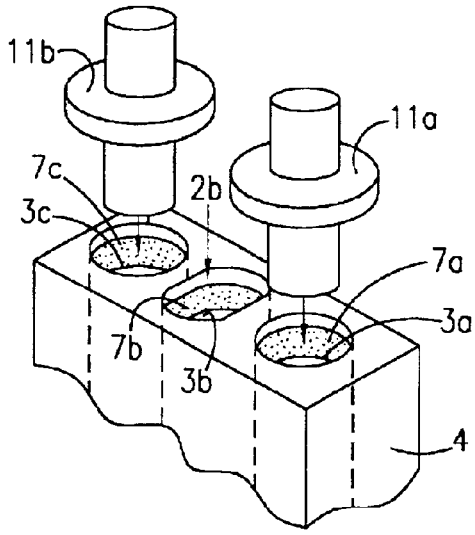
FIG. 1C is a partial perspective view of a dielectric filter in accordance with the first embodiment of the present invention.

FIG. 1A is a perspective view of a dielectric filter of the first embodiment of the present invention, and FIG. 1B is a top plan view of an open circuited end of the dielectric filter of FIG. 1A. FIG. 1C is a perspective view of a dielectric filter in accordance with the first embodiment wherein an input-output electrode is not provided on the external conductor.

In FIGS. 1A to 1C, a dielectric block 1, through holes 2*a* to 2*c*, internal conductors 3*a* to 3*c*, an external conductor 4, external-conductor-free portions 5, input-output electrodes 6, internal-conductor-free portions 7*a* to 7*c*, and input-output pins 11*a* and 11*b* are shown.

Preferably, the dielectric block 1 is in the form of a substantially rectangular solid. The holes 2*a* to 2*c* pass through the dielectric block 1 from one surface 1*a* to the opposite surface 1*b*. On the inside surface of the conductive through holes 2*a* to 2*c*, the internal conductors 3*a* to 3*c* are formed, respectively, so as to form respective conductive through holes. The external conductor 4 is preferably formed substantially on the whole outside surface of the dielectric block 1. The internal-conductor-free portions 7*a* to 7*c* are provided on the inside surface of the conductive through holes 2*a* to 2*c* such that the internal conductors 3*a* to 3*c* are separated from the external conductor 4 and form open circuited ends. In other words, the conductor-free portions 7*a* to 7*c* of each conductive through hole capacitively couple the conductive through holes to the external conductor and form the open circuited ends thereof. The other ends of the conductive through holes are directly coupled to the external conductor 4 so as to form the short circuited ends. In this way, dielectric resonators are formed by the internal conductors 3*a* to 3*c*, the dielectric block 1, and the external conductor 4.

The conductive through holes 2*a* and 2*c* are formed so as to be circular in section, and the conductive through hole 2*b* is formed so as to be elongated in the width direction of the dielectric block. In other words, the width of the elongated through hole 2*b* in a direction perpendicular to the direction of arrangement of the conductive through holes 2*a* to 2*c* is larger than the width of the through hole 2*b* in a direction parallel to the arrangement of through holes.

Preferably, two input-output electrodes 6 are formed on the outside surface of the dielectric block 1 and extend from opposite end faces thereof. The input-output electrodes 6 are preferably provided at opposite sides of the arrangement of the conductive through holes 2*a* to 2*c* and are separated from the external conductor 4 by the external-conductor-free portions 5. Also, the input-output electrodes 6 preferably overlap a common mounting surface 4*a* so as to facilitate easy mounting to a substrate.

In this way, a dielectric filter is formed by the two input-output electrodes 6 and the three dielectric resonators.

When constructed in this way, the space from the open end of the conductive through hole 2*b* to the mounting surface 4*a* and surface 4*b* opposite the mounting surface is narrowed. Accordingly, the coupling capacitance generated between the internal conductors 3*a* and 3*c* through the dielectric block is decreased.

Figure 2A:
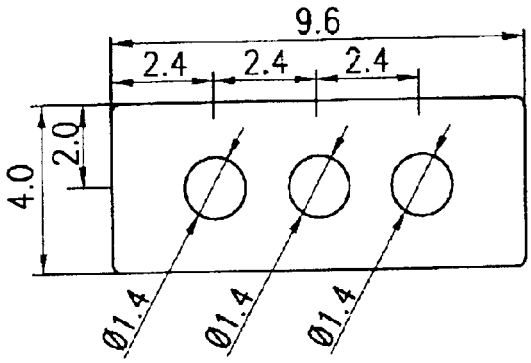
PRIOR ART FIG. 2A
FIG. 2A is a top plan view of a dielectric filter wherein the through holes are circular and of equal diameter.
Figure 2B:
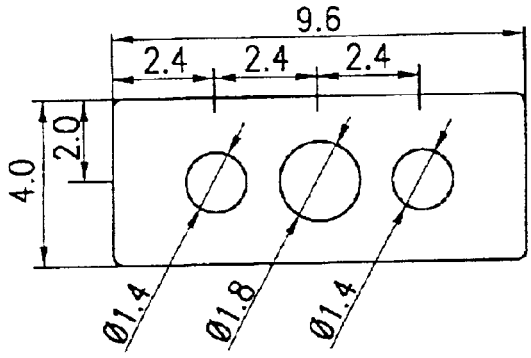
PRIOR ART FIG. 2B
FIG. 2B is a top plan view of a dielectric filter wherein the through holes are circular and the middle through hole is larger in diameter than the outer through holes.
Figure 2C:
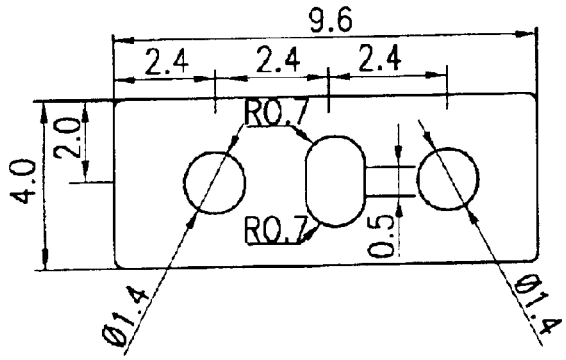
FIG. 2C is a top plan view of a dielectric filter according to the first embodiment of the present invention.

FIGS. 2A and 2B are top plan views of the open circuited end of known dielectric filters, and FIG. 2C is a top plan view of the open circuited end of a dielectric filter of the present invention. In particular, FIG. 2A shows a known filter in which the middle conductive through hole is circular in section and the holes are equal in diameter, FIG. 2B shows another known filter in which the middle conductive through hole is circular in section and is larger in diameter than the others, and FIG. 2C shows a filter according to the present invention in which the middle conductive through hole is elongated in the width direction of the dielectric block, or elliptical in section. Moreover, the dimensions shown in FIGS. 2A to 2C are in millimeters and are not intended to limit the present invention to the specific dimensions shown. Accordingly, the dimensions are provided for illustrative purposes only.

Figure 3:
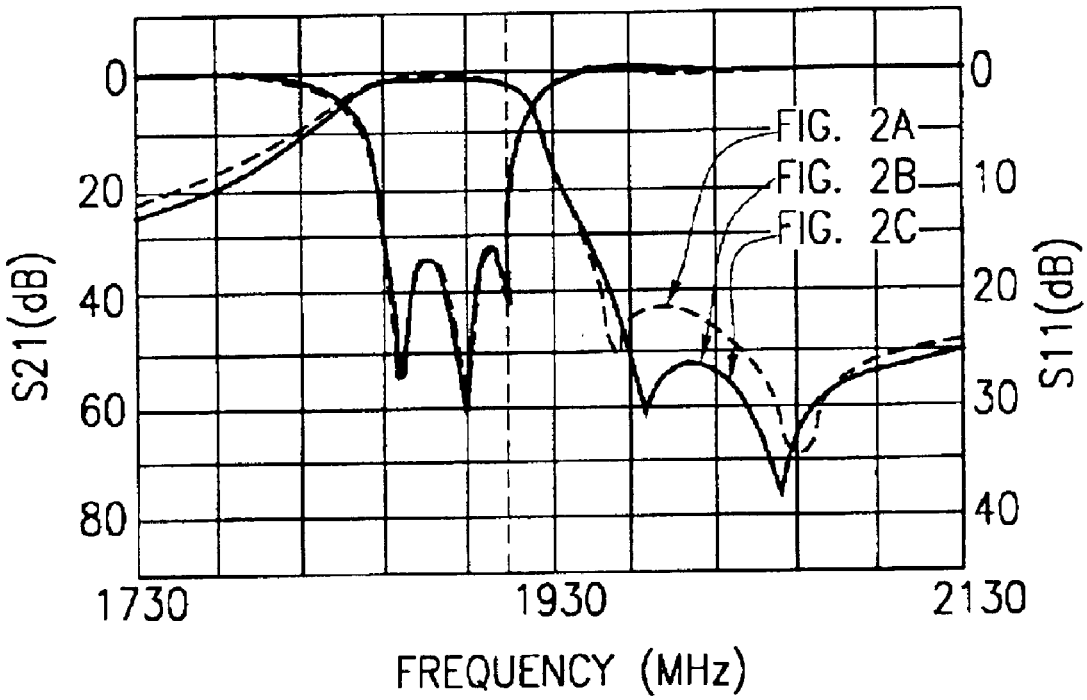
FIG. 3 is a graph showing the attenuation characteristics of the dielectric filters of FIGS. 2A, 2B and 2C, respectively.

FIG. 3 is a graph showing the frequency characteristics of the dielectric filters of FIGS. 2A to 2C, respectively.

The jumping coupling capacitance and Q0 of the dielectric filters having the construction shown in FIGS. 2A to 2C are shown in Table 1. Moreover, Table 1 shows Q0 in even mode and in odd mode. Generally, Q0 in odd mode is worse than Q0 in even mode and has greater effects on insertion loss. Accordingly, a filter having better Q0 in odd mode generally shows better characteristics.

TABLE 1

| Conductive Through Hole Shape | Jumping tip capacitance (pF) | $Q_0$ (odd mode) | $Q_0$ (even mode) |
|---|---|---|---|
| Circular, FIG. 2A | −0.01074 | 616.4 | 749.4 |
| Circular and Large in Diameter, FIG. 2B | −0.00555 | 563.6 | 714.9 |
| Elliptical | −0.00577 | 595.0 | 683.9 |

As shown in Table 1, in the dielectric filter in which the conductive through hole has a large circular section, and the dielectric filter of the present invention in which the conductive through hole is elongated in the width direction of the dielectric block, or elliptical in section, the jumping coupling capacitance is decreased to a greater extent than that of the dielectric filter in which the conductive through hole is circular in section. Furthermore, in the filters having a large circular section and an elliptical section, Q0 in odd mode is decreased to a greater extent than in the filter having a circular section.

However, in the dielectric filter in which the conductive through hole is elongated in the width direction of the dielectric block, even if the jumping capacitance is the same as that in the dielectric filter in which the conductive through hole has a large circular section, Q0 in odd mode is less deteriorated.

As shown in FIG. 3, in the dielectric filter in which the conductive through hole has an elliptical section (FIG. 2C) and the dielectric filter in which the conductive through hole has a large circular section (FIG. 2B), the attenuation pole frequencies are shifted such that the space between the two attenuation poles due to jumping coupling capacitance is narrowed more than that of the dielectric filter in which the conductive through hole has a circular section (FIG. 2A), and both dielectric filters have substantially the same frequency characteristics.

As shown in Table 1, since the dielectric filter of the present invention in which the conductive through hole has an elliptical section has a high Q0 in odd mode, the insertion loss can be reduced. For example, in the characteristics shown in FIG. 3, the dielectric filter in which the conductive through hole has a large circular section has an insertion loss of 2.33 dB at 1910 MHz and the dielectric filter in which the conductive through hole has an elliptical section has an insertion loss of 2.20 dB at 1910 MHz (frequency shown by a broken line).

Accordingly, when the middle conductive through hole is provided such that the width perpendicular to the direction of arrangement of the conductive through holes is larger than the width parallel to the direction of the arrangement, the deterioration of insertion loss is suppressed, and the attenuation pole frequencies can be shifted such that the space between two attenuation poles due to jumping coupling capacitance is narrowed.

Moreover, as shown in FIG. 1C, if a dielectric filter is constructed such that no input-output electrode is provided in the external conductor 4 and the dielectric filter is connected to an outside circuit by inserting the input-output pins 11*a* and 11*b* on the open end of the conductive through holes 2*a* and 2*c*, the same effect can be obtained.

Next, the construction of a dielectric filter according to a second embodiment of the present invention is described with reference to FIGS. 4A and 4B.

Figure 4A:
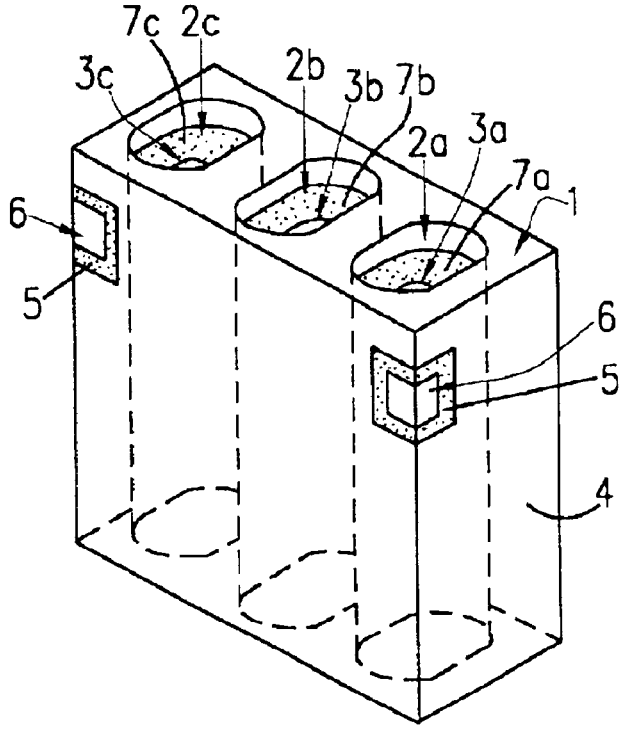
FIG. 4A is a perspective view of a dielectric filter according to a second embodiment of the present invention.
Figure 4B:
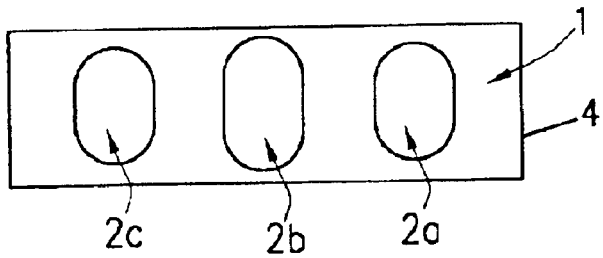
FIG. 4B is a top plan view of the dielectric filter of FIG. 4.

FIG. 4A is a perspective view of the dielectric filter according to a second embodiment of the present invention, and FIG. 4B is a top plan view of the open end of the dielectric filter of FIG. 4A.

In the dielectric filter shown in FIGS. 4A and 4B, the sectional shape of the conductive through holes 2*a*, 2*b*, and 2*c* are elliptical such that the width perpendicular to the direction of arrangement of the conductive through holes is larger than the width parallel to the direction of the arrangement. Also, the conductive through hole 2*b* is larger in diameter than the conductive through holes 2*a* and 2*c*. The remaining elements are similar to those described above with reference to FIG. 1A wherein like reference numerals represent like elements.

When constructed in this manner, the shape of the conductive through holes generating jumping coupling capacitance can be changed and the frequency position of attenuation poles can be adjusted in a wider range.

For example, if the larger diameter of the middle conductive through hole 2*b* is kept constant, and the larger diameter of the conductive through holes 2*a* and 2*c* is increased, but remains smaller than that of the through hole 2*b*, the jumping coupling capacitance generated between the resonators at both ends increases and the attenuation pole frequencies can be shifted such that the space between two attenuation poles is widened.

Next, the construction of a dielectric filter according to a third embodiment of the present invention is described with reference to FIGS. 5A, 5B and 6.

Figure 5A:
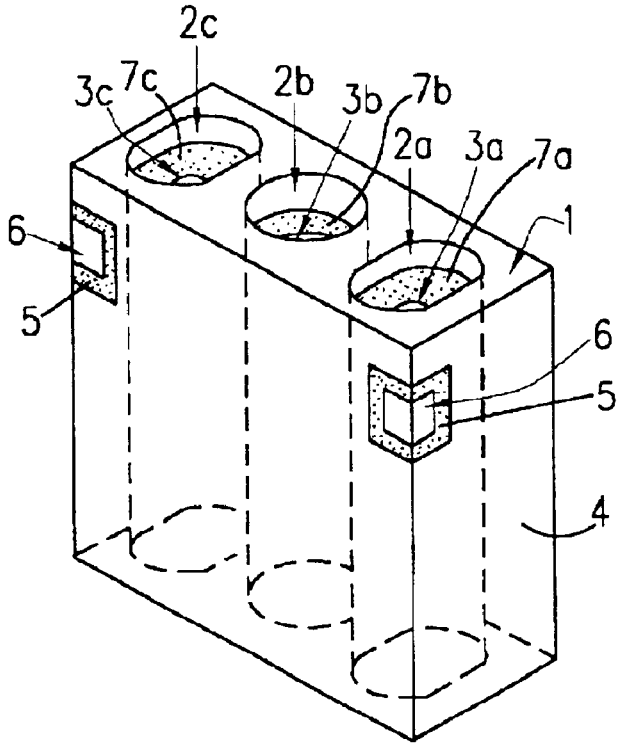
FIG. 5A is a perspective view of a dielectric filter according to a third embodiment of the present invention.
Figure 5B:
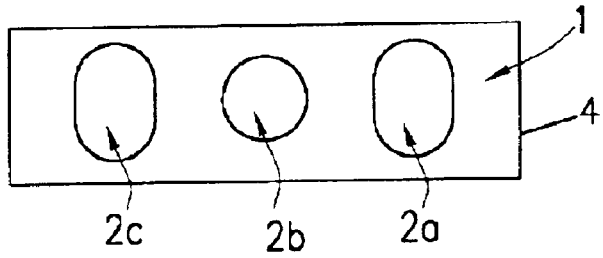
FIG. 5B is a top plan view of the dielectric filter of FIG. 5A.

FIG. 5A is a perspective view of the dielectric filter according to a third embodiment of the present invention, and FIG. 5B is a top plan view of the open circuited end of the dielectric filter of FIG. 5A.

Figure 6:
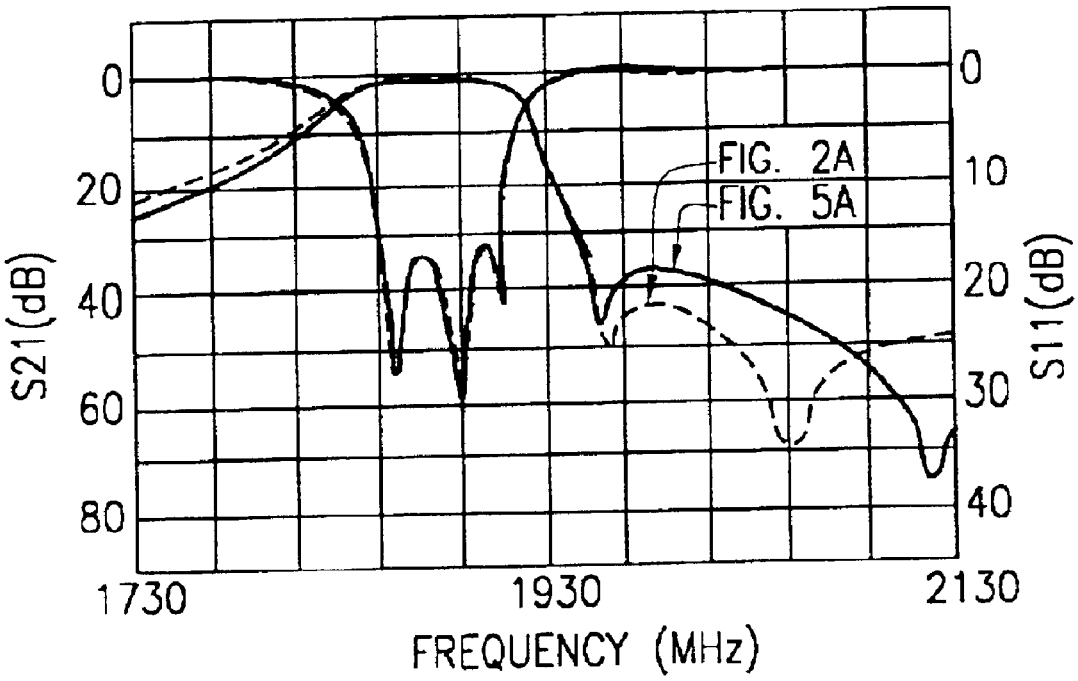
FIG. 6 is a graph showing the attenuation characteristics of the dielectric filter according to the third embodiment of FIG. 5A and the dielectric filter of FIG. 2A.

FIG. 6 shows the frequency characteristics of the dielectric filter having the construction shown in FIGS. 5A and 5B and the dielectric filter shown in FIG. 2A.

In the dielectric filter shown in FIGS. 5A and 5B, the conductive through holes 2*a* and 2*c* are formed to be elliptical in section such that the width perpendicular to the direction of arrangement of the conductive through holes is larger than the width parallel to the direction of the arrangement, and the conductive through hole 2*b* is formed so as to be circular in section. The remaining elements are similar to those described above with reference to FIG. 1A wherein like reference numerals represent like elements.

When constructed in this way, the jumping coupling capacitance generated between the resonators of the conductive through holes 2*a* and 2*c* at both ends increases, and the space between two attenuation poles due to the jumping coupling capacitance can be widened.

Moreover, in the present embodiment the middle conductive through hole 2*b* is preferably formed so as to be circular in section wherein the diameter of which is smaller than the larger diameter of the conductive through holes 2*a* and 2*c* at both ends. When constructed in this way, the position of the attenuation pole frequencies can be adjusted.

Next, the construction of a dielectric filter according to a fourth embodiment of the present invention is described with reference to FIGS. 7A to 7C.

Figure 7A:
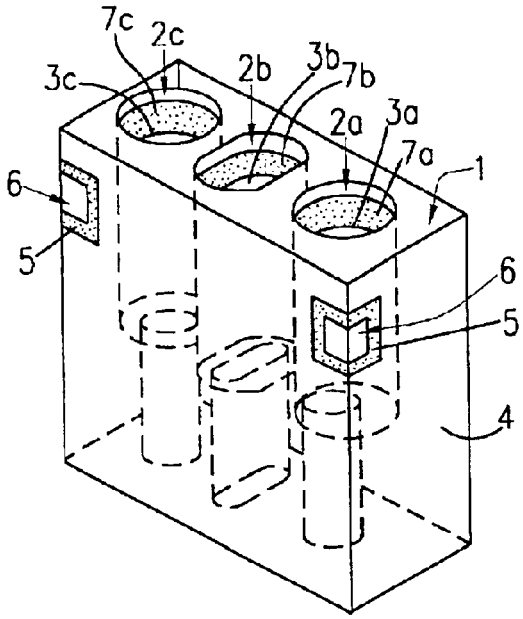
FIG. 7A is a perspective view of a dielectric filter according to a fourth embodiment of the present invention.
Figure 7B:
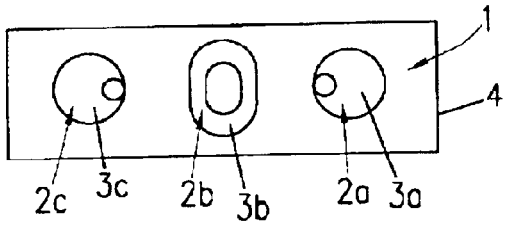
FIG. 7B is a top plan view of the dielectric filter of FIG. 7A.

FIG. 7A is a perspective view of the dielectric filter according to the fourth embodiment, and FIG. 7B is a top plan view of the open circuited end of the dielectric filter of FIG. 7A. Furthermore, FIG. 7C is a top plan view of a dielectric filter having conductive through holes of another construction.

In the dielectric filter shown in FIGS. 7A and 7B, each conductive through hole is formed so as to be a stepped hole in which the inner diameter on the open circuited end is larger than the inner diameter on the short circuited end. Furthermore, in each of the conductive through holes 2*a* and 2*c*, the axial position of each portion of the stepped holes is different. In other words, as shown in FIGS. 7A and 7B, the axial position of the narrower stepped portion on the side of the short-circuited end of through holes 2*a* and 2*c* is shifted such that the axial position thereof becomes closer to the conductive through hole 2*b*. The remaining elements are similar to those described above with reference to FIG. 1A wherein like reference numerals represent like elements.

Figure 7C:
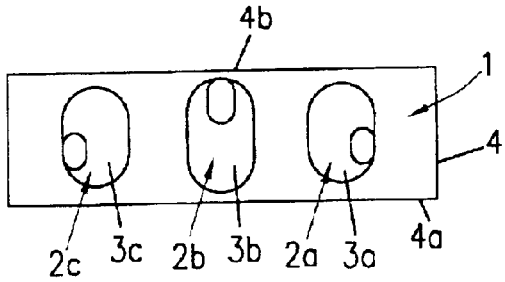
FIG. 7C is a top plan view of a dielectric filter in accordance with the fourth embodiment of the present invention.

In the dielectric filter shown in FIG. 7C, each conductive through hole is formed so as to be elliptical in section at the short circuited end and at the open circuited end. Furthermore, each hole is made stepped such that the inner diameter on the open circuited end is larger than the inner diameter on the short circuited end. Moreover, the axial position of the hole on the side of the short circuited end of the conductive through holes 2*a* and 2*c* is shifted towards the mounting surface 4*a*, and the axial position of the hole on the side of the short circuited end of the conductive through hole 2*b* is shifted to the surface 4*b* opposite to the mounting surface 4*a*. The remaining elements are similar to those described above with reference to FIG. 1A wherein like reference numerals represent like elements.

When constructed in this way, the degree of freedom for adjustment of the jumping coupling capacitance increases by changing the inner diameter, shape, and length of the stepped holes and the relation of the axial position of the short-circuited end of the through holes relative to the axial position of the open end of the through holes. Furthermore, the degree of freedom for coupling between resonators and distributed constants between resonators and grounded electrodes increases.

The input-output terminals in the dielectric filters according to the above embodiments are preferably formed so as to extend from the end faces of the dielectric block 1 at opposite ends of the arrangement of the conductive through holes and from the surface of the dielectric block which contacts the mounting surface. In an alternate embodiment, the input-output electrodes may be provided in the same axial direction as the conductive through holes and formed so as to extend from the opening surface of the conductive through holes.

Next, an aspect of the present invention wherein the dielectric filter is used to construct a dielectric duplexer is described with reference to FIG. 8.

Figure 8:
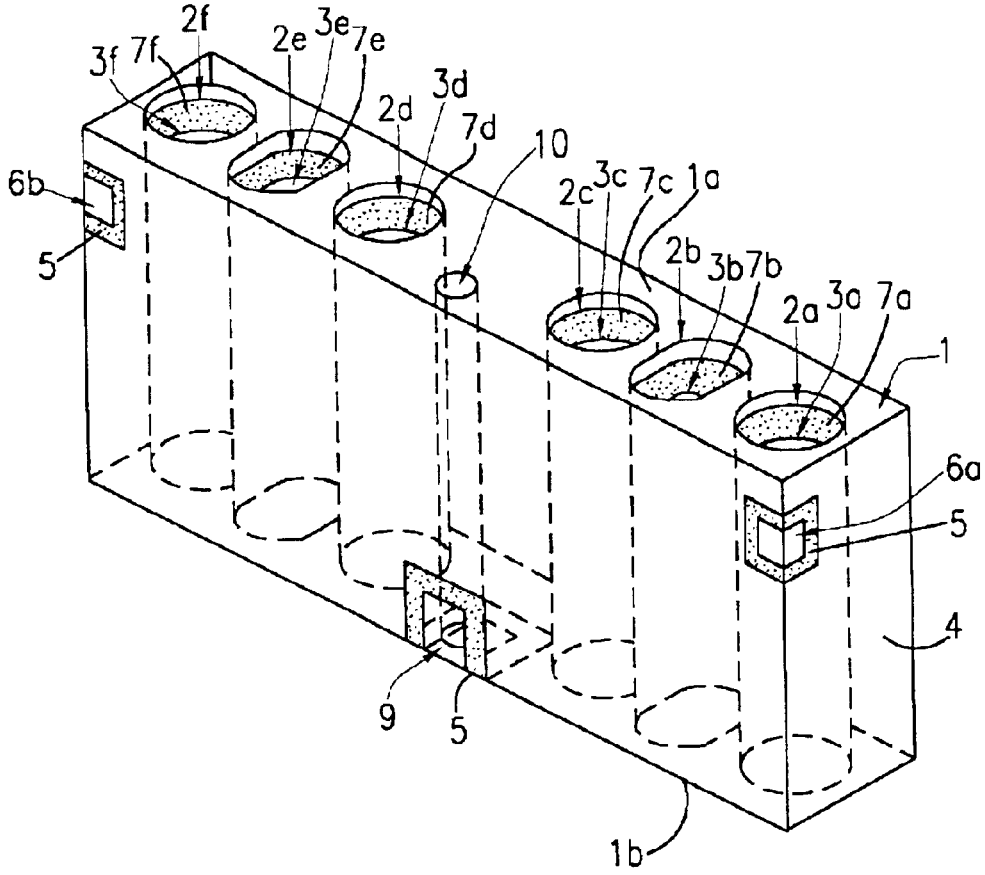
FIG. 8 is a perspective view of a dielectric duplexer according to one aspect of the present invention.

In FIG. 8, a dielectric block 1, through holes 2*a* to 2*f*, internal conductors 3*a* to 3*f*, an external conductor 4, external-conductor-free portions 5, input-output electrodes 6*a* and 6*b*, an antenna terminal 9, and an antenna excitation hole 10 are shown.

Preferably, the dielectric block 1 is in the form of a substantially rectangular solid. The holes 2*a* to 2*f* pass through the dielectric block 1 from one surface 1*a* to the opposite surface 1*b*. On the inside surface of the conductive through holes 2*a* to 2*f*, the internal conductors 3*a* to 3*f* are formed, respectively, so as to form respective conductive through holes. The external conductor 4 is preferably formed substantially on the whole outside surface of the dielectric block 1. The internal-conductor-free portions 7*a* to 7*f* are provided on the inside surface of the conductive through holes 2*a* to 2*f* such that the internal conductors 3*a* to 3*f* are separated from the external conductor 4 and form open circuited ends. In other words, the conductor-free portions 7*a* to 7*f* of each conductive through hole capacitively couple the conductive through holes to the external conductor and form the open circuited ends thereof. The other ends of the conductive through holes are directly coupled to the external conductor 4 so as to form the short circuited ends. In this way, dielectric resonators are formed by the internal conductors 3*a* to 3*f*, the dielectric block 1, and the external conductor 4.

As shown in FIG. 8, the conductive through holes 2*a*, 2*c*, 2*d*, and 2*f* are circular in section, and the conductive through holes 2*b* and 2*e* are elliptical, or elongated in section such that the width perpendicular to the direction of the arrangement of the conductive through holes 2*a* to 2*f* is larger than the width parallel to the direction of the arrangement.

The input-output electrodes 6*a* and 6*b* are formed on the outside surface of the dielectric block 1 so as to extend from the end faces at the opposite ends of the arrangement of the conductive through holes 2*a* to 2*f* and from the surface to which the dielectric block is to be mounted to a mounting substrate. The input-output electrodes 6*a* and 6*b* are separated from the external conductor 4 by the external-conductor-free portions 5. Between the conductive through holes 2*c* and 2*d*, the antenna terminal 9 is formed so as to extend from the mounting surface to the short-circuited surface 1*b* and is separated from the external conductor 4 by the external-conductor-free portion 5. The antenna excitation hole 10 is provided in the same axial direction as the conductive through holes 2*a* to 2*f*. An electrode is formed on the inside surface of the antenna excitation hole 10 and the electrode is made conductive to the antenna terminal 9.

In this way, one dielectric filter is constructed from the three dielectric resonators formed from the conductive through holes 2*a* to 2*c*, the input-output electrode 6*a* and the antenna terminal 9. Another dielectric filter is constructed from the three dielectric resonators formed from the conductive through holes 2*d* to 2*f*, the input-output electrode 6*b* and the antenna terminal 9. These two dielectric filters are used as a dielectric duplexer such that one dielectric filter is operates as a filter on the transmission side and that the other operates as a filter on the reception side.

When constructed in this way, a dielectric duplexer is constructed in which the attenuation poles on the transmission-side filter and on the reception-side filter are adjusted, and the attenuation characteristics outside the passband are adjusted and improved.

Next, another aspect of the present invention wherein the dielectric filter is used to construct a dielectric duplexer is described with reference to FIG. 9.

Figure 9:
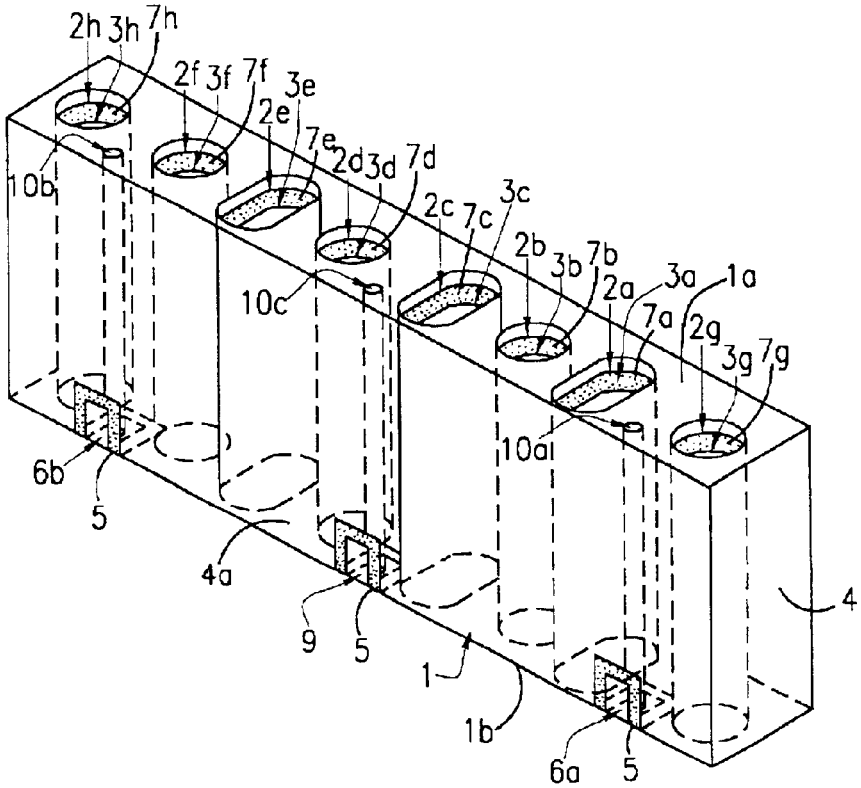
FIG. 9 is a perspective view of a dielectric duplexer according to another aspect of the present invention.

In FIG. 9, a dielectric block 1, through holes 2*a* to 2*h*, internal conductors 3*a* to 3*h*, an external conductor 4, external-conductor-free portions 5, input-output electrodes 6*a* and 6*b*, internal-conductor-free portions 7*a* to 7*h*, an antenna terminal 9, and excitation holes 10*a*, 10*b*, and 10*c* are shown.

Preferably, the dielectric block 1 is in the form of a substantially rectangular solid. The holes 2*a* to 2*h* pass through the dielectric block 1 from one surface 1*a* to the opposite surface 1*b*. On the inside surface of the conductive through holes 2*a* to 2*h*, the internal conductors 3*a* to 3*h* are formed, respectively, so as to form respective conductive through holes. The external conductor 4 is preferably formed substantially on the whole outside surface of the dielectric block 1. The internal-conductor-free portions 7*a* to 7*h* are provided on the inside surface of the conductive through holes 2*a* to 2*h* such that the internal conductors 3*a* to 3*h* are separated from the external conductor 4 and form open circuited ends. In other words, the conductor-free portions 7*a* to 7*h* of each conductive through hole capacitively couple the conductive through holes to the external conductor and form the open circuited ends thereof. The other ends of the conductive through holes are directly coupled to the external conductor 4 so as to form the short circuited ends. In this way, dielectric resonators are formed by the internal conductors 3*a* to 3*h*, the dielectric block 1, and the external conductor 4.

As shown in FIG. 9, the conductive through holes 2*b*, 2*d*, 2*f*, 2*g*, and 2*h* are circular in section, and the conductive through holes 2*a*, 2*c*, and 2*e* are elliptical in section such that the width thereof perpendicular to the direction of arrangement of the conductive through holes is larger than the width thereof parallel to the direction of the arrangement.

On the outside surface of the dielectric block 1, the input-output electrodes 6*a* and 6*b* and the antenna terminal 9 are formed so as to extend from the mounting surface 4*a* to the short-circuited surface 1*b* of the dielectric block 1 and are separated from the external conductor 4 by external-conductor-free portions 5. The input-output electrode 6*a* is formed between the conductive through holes 2*a* and 2*g*, the input-output electrode 6*b* is formed between the conductive through holes 2*f* and 2*h*, and the antenna terminal 9 is formed between the conductive through holes 2*c* and 2*d*.

The excitation holes 10*a* to 10*c* are provided in the same axial direction as the conductive through holes 2*a* to 2*h*.

Electrodes are formed on the inside surface of excitation holes 10*a* and 10*b* and made conductive to the input-output terminals 6*a* and 6*b*, respectively. Similarly, an electrode is formed on the inside surface of excitation hole 10*c* and made conductive to the antenna terminal 9.

In this way, one dielectric filter is constructed from the three dielectric resonators formed from the conductive through holes 2*a* to 2*c*, the input-output electrode 6*a*, the antenna terminal 9, and the dielectric resonator formed from the conductive through hole 2*g* which functions as a resonator trap. Another dielectric filter is constructed from the three dielectric resonators formed from the conductive through holes 2*d* to 2*f*, the input-output electrode 6*b*, the antenna terminal 9, and the dielectric resonator formed from the conductive through hole 2*h* which functions as a resonator trap. These dielectric filters are used as a dielectric duplexer such that one dielectric filter is a transmission-side filter and that the other filter is a reception-side filter.

When constructed in this way, a dielectric duplexer is constructed in which the attenuation poles on the transmission-side filter and on the reception-side filter are adjusted, and the attenuation characteristics outside the passband are adjusted and improved. In this way, the interference between signals in the frequency area between the passband in the transmission-side filter and the passband in the reception-side filter can be suppressed. Furthermore, the effect of the suppression can be further enhanced such that a resonator trap is provided so as to generate the attenuation poles in the frequency area.

In the dielectric filters shown in the first, second, and third embodiments and the dielectric duplexers shown in the FIGS. 8 and 9, the conductive through holes are constructed as a straight hole. In an alternate embodiment, the conductive through holes may be constructed as stepped holes in which the inside diameter on the open circuited end is different from the inside diameter on the short circuited end.

Next, the construction of a communication device according to an aspect of the present invention is described with reference to FIG. 10.

Figure 10:
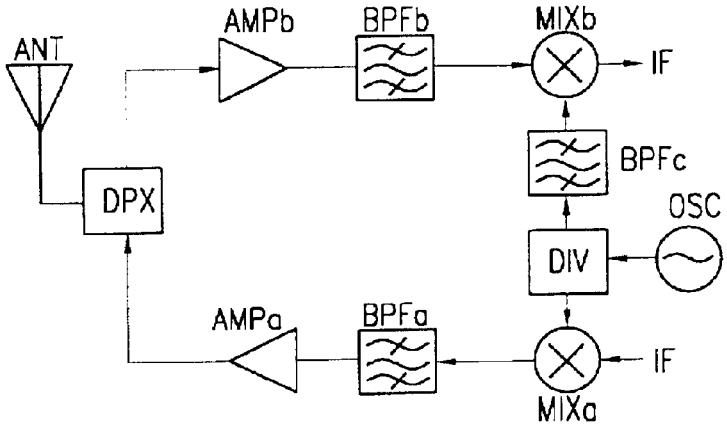
FIG. 10 is a block diagram of a communication device according to another aspect of the present invention.
Figure 11A:
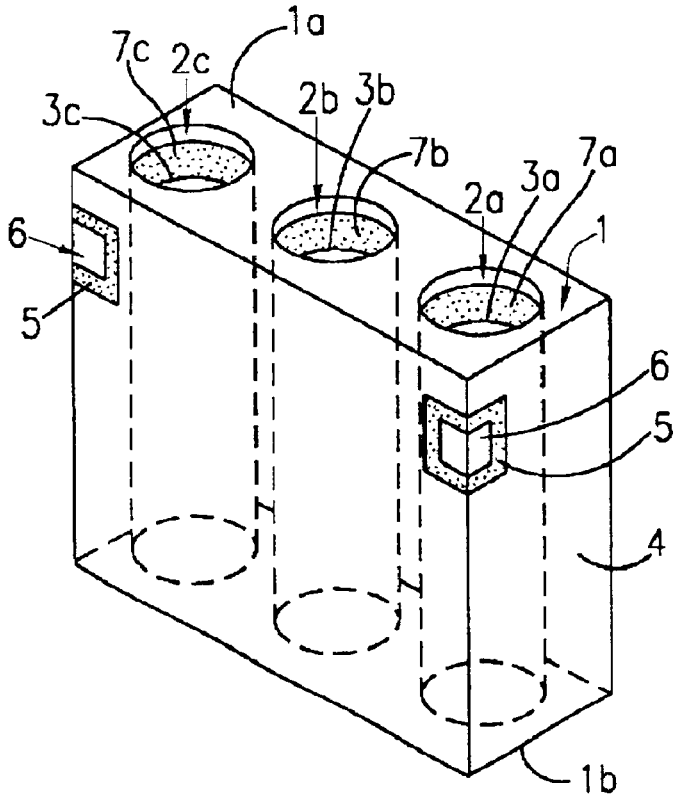
PRIOR ART FIG. 11A
FIG. 11A is a perspective view of typical dielectric filter.
Figure 11B:
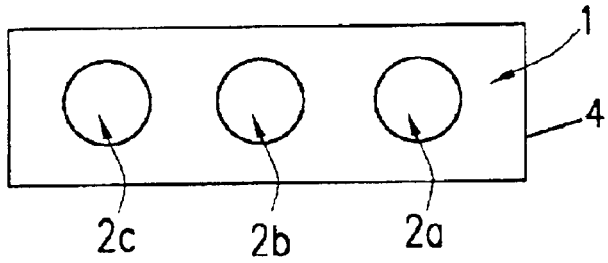
PRIOR ART FIG. 11B
FIG. 11B is a top plan view of the dielectric filter of FIG. 11A.
Figure 12A:
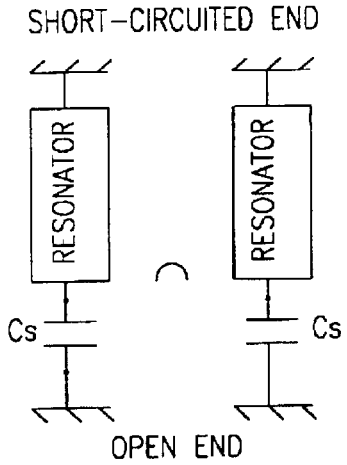
FIG. 12A is a circuit diagram of a two-stage dielectric resonator.
Figure 12B:
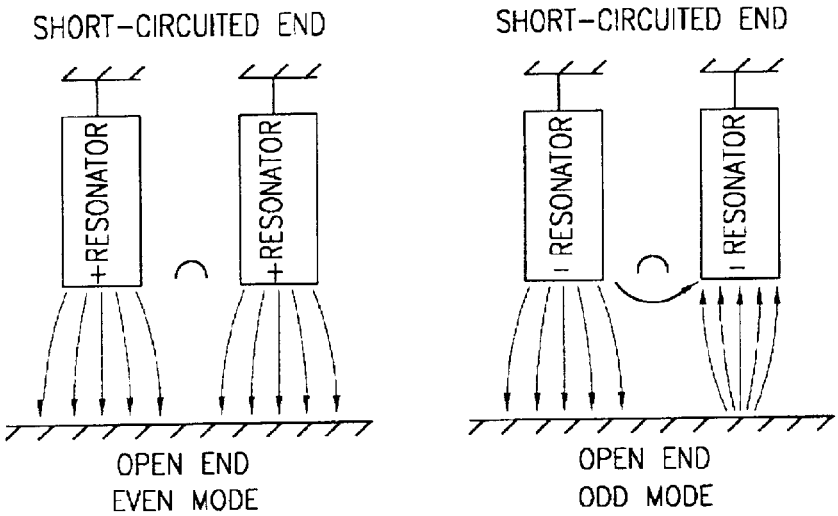
FIG. 12B is a diagram showing the state of electric lines of force in an even mode and in an odd mode of the dielectric resonator of FIG. 12A.
Figure 12C:
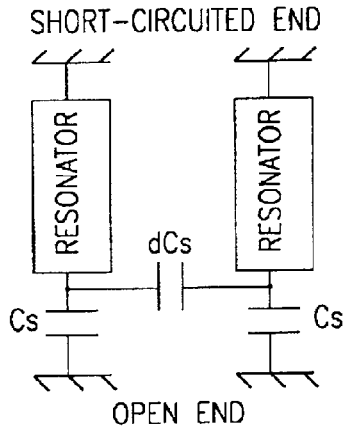
FIG. 12C is a circuit diagram of a two-stage dielectric resonator illustrating the jumping coupling capacitance.
Figure 13A:
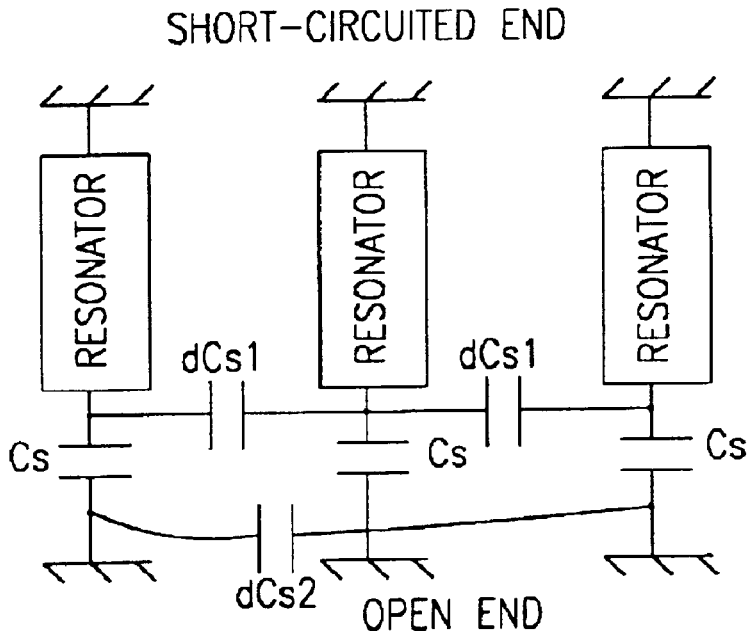
FIG. 13A is a circuit diagram of a three-stage dielectric resonator.
Figure 13B:
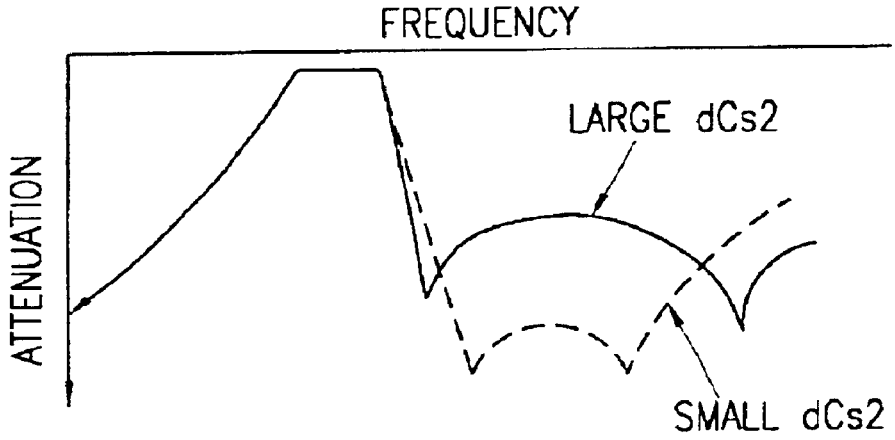
FIG. 13B is a graph showing the attenuation characteristics of a dielectric filter provided with the three-stage dielectric resonator of FIG. 13A.
Figure 14A:
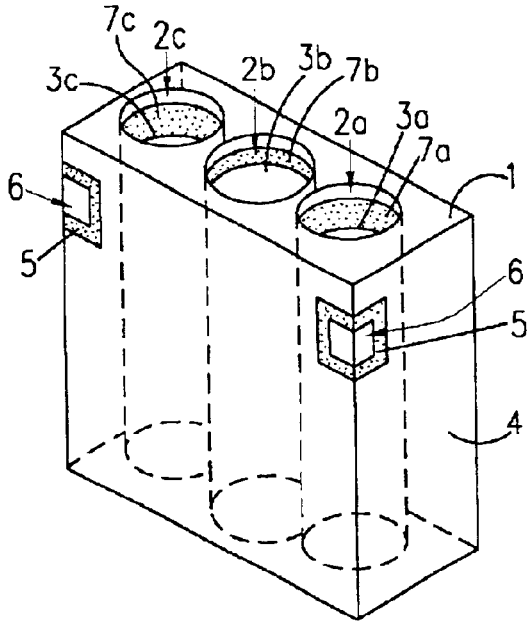
PRIOR ART FIG. 14A
FIG. 14A is a perspective view of a known dielectric filter.
Figure 14B:
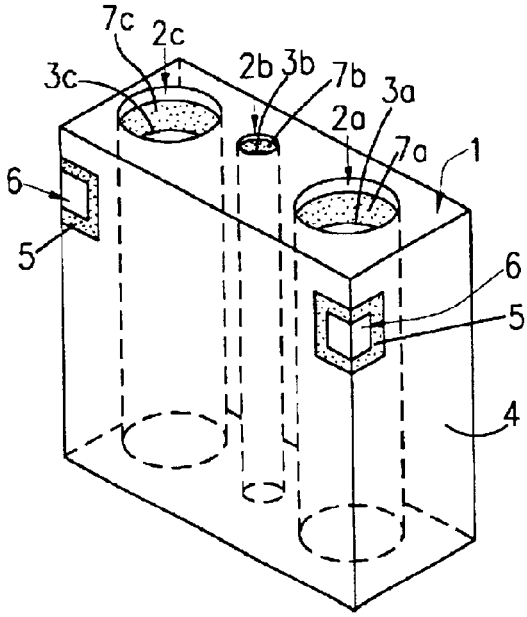
PRIOR ART FIG. 14B
FIG. 14B is a perspective view of another known dielectric filter.

In FIG. 10, a transmission-reception antenna ANT, a duplexer DPX, bandpass filters BPFa, BPFb, and BPFc, amplifiers AMPa and AMPb, mixers MIXa and MIXb, an oscillator OSC, and a divider (synthesizer) DIV are shown. The mixer MIX modulates a frequency signal output from the divider DIV by an IF signal. The bandpass filter BPFa makes only the transmission frequency band pass through, and the amplifier AMPa power amplifies the transmission frequency band and transmits that from the antenna ANT through the duplexer DPX. The amplifier AMPb amplifies a signal to be output from the duplexer DPX, and the bandpass filter BPFb makes only the reception frequency band out of a signal to be output from the amplifier AMPb pass through. The mixer MIXb mixes a frequency signal output from the bandpass filter BPFc and a reception signal to output an intermediate-frequency signal IF.

In the filters shown in FIG. 10, the dielectric filters having the construction shown in FIGS. 1, 4, 5, and 7 can be used, and the dielectric duplexers having the construction shown in FIGS. 8 and 9 can be used as the duplexer in FIG. 10. In this way, a communication device having a simple construction as a whole and excellent communication characteristics can be constructed.

According to the present invention, a dielectric filter constructed such that at least one elliptical conductive through hole is formed wherein the sectional width perpendicular to the direction of arrangement of conductive through holes is larger than the sectional width parallel to the direction of arrangement of conductive through holes, capacitance generated between the internal conductors of the two conductive through holes on both sides of the elliptical conductive through hole is decreased, and the space between two attenuation poles due to jumping coupling is narrowed. As a result, the deterioration of insertion loss is suppressed and desired attenuation characteristics outside the passband can be obtained.

Furthermore, according to the present invention, a dielectric filter constructed such that two elliptical conductive through holes sandwiching at least one conductive through hole are formed wherein the sectional width perpendicular to the direction of arrangement of conductive through holes is larger than the sectional width parallel to the direction of arrangement of conductive through holes, capacitance generated between the internal conductors of the two elliptical conductive through holes is increased. As a result, by increasing the space between two attenuation poles due to jumping coupling, the deterioration of insertion loss is suppressed and desired attenuation characteristics outside the passband can be obtained.

Furthermore, according to the present invention, when all the conductive through holes are formed such that their sectional width perpendicular to the direction of arrangement of conductive through holes is larger than the sectional width parallel to the direction of arrangement of conductive through holes, a dielectric filter is constructed in which the degree of freedom for designing jumping coupling capacitance is improved, the position of attenuation pole frequencies is adjusted in a wide frequency range and the attenuation characteristics can be improved.

Furthermore, according to the present invention, coupling capacitance can be established by forming the conductive through holes as a stepped hole such that the conductive through holes have different inner diameters on the open circuited end relative to the short circuited end. In addition, the stepped conductive through holes can be formed such that the sectional width perpendicular to the direction of arrangement of conductive through holes is larger than the sectional width parallel to the direction of arrangement of conductive through holes on the open circuited end of the conductive through holes. In this way, a plurality of coupling capacitances can be established using a similarly sized dielectric block and the degree of freedom for designing coupling capacitance can be improved.

Furthermore, according to the present invention, the stepped conductive through holes can be formed such that the axial position of the conductive through holes on the open circuited end is different from the axial position on the short circuited end such that a plurality of coupling capacitance can be designed. In this way, a dielectric filter can be constructed in which the degree of freedom for designing is high.

Furthermore, according to an aspect of the present invention, a dielectric duplexer can be constructed in which attenuation characteristics outside the passband are improved on each of the transmission side and reception side by utilizing the above-described dielectric filter.

Furthermore, according to another aspect of the present invention, a communication device having excellent communication characteristics can be constructed by incorporating the above-described dielectric filter or the above duplexer.

What is claimed is:

1. A dielectric filter comprising:

a dielectric block having first and second opposed surfaces, the first and second opposed surfaces having a length direction and a width direction, the length direction being greater than the width direction;

an external conductor formed on exterior surfaces of the dielectric block; and at least three conductive through holes arrayed along the length direction of the first and second opposed surfaces, each of the at least three conductive through holes extending from the first to the second surface of the dielectric block, each conductive through hole having a short circuit end directly coupled to the external conductor and an open circuit end capacitively coupled to the external conductor, wherein a sectional shape of at least one conductive through hole located between two other conductive through holes of the at least three conductive through holes is different from those of the two other conductive through holes and is elongated in the width direction of the first and second opposed surfaces such that top and bottom ends of the sectional have arc shapes, and wherein a sectional shape of the two other conductive through holes is elongated in the width direction, and the at least one elongated through hole located between the two other conductive through holes is elongated greater than the two other conductive through holes.

2. The dielectric filter as claimed in claim 1, wherein there is no electrode pattern on a surface of the open circuit end which directly connects to the conductive through holes.

3. The dielectric filter as claimed in claim 1, wherein at least one of the at least three conductive through holes is a stepped hole.

4. The dielectric filter as claimed in claim 3, wherein the stepped through hole is the elongated through hole between the tow other conductive through holes.

5. The dielectric filter as claimed in claim 3, wherein the at least one stepped through hole has a diameter on the short circuit end different from the diameter on the open circuit end.

6. The dielectric filter as claimed in claim 5, wherein an axial position of the at least one stepped through hole at the short circuit end is different from an axial position at the open circuit end.

7. A dielectric duplexer containing a dielectric filter as claimed in claim 1.

8. A communication device containing a dielectric filter as claimed in claim 1.

9. The dielectric filter as claimed in claim 1, wherein the two other through holes are coupled with input-output electrodes, respectively.

10. A dielectric filter comprising:

a dielectric block having first and second opposed surfaces, the first and second opposed surfaces having a length direction and a width direction, the length direction being greater than the width direction;

an external conductor formed on exterior surfaces of the dielectric block; and at least three conductive through holes arrayed in the length direction of the first and second opposed surfaces, each of the at least three conductive through holes extending from the first to the second surface of the dielectric block, each conductive through hole having a short circuit end directly coupled to the external conductor and an open circuit end capacitively coupled to the external conductor, wherein a sectional shape of two conductive through holes on either side of a third conductive through hole of the at least three conductive through holes is different from that of the third conductive through hole and is elongated in the width direction of the first and second opposed surfaces such that top and bottom ends of the sectional shape have arc shapes, and wherein a sectional shape of the two conductive through holes is elongated in the width direction, and a sectional shape of the third conductive through hole located between the two conductive through holes is elongated greater than the two conductive through holes.

11. The dielectric filter as claimed in claim 10, wherein at least one of the at least three conductive through holes is a stepped hole.

12. The dielectric filter as claimed in claim 11, wherein the two elongated conductive through holes are stepped through holes.

13. The dielectric filter as claimed in claim 11, wherein the at least one stepped through hole has a diameter on the short circuit end different from the diameter on the open circuit end.

14. The dielectric filter as claimed in claim 13, wherein an axial position of the at least one stepped through hole at the short circuit end is different from an axial position at the open circuit end.

15. A dielectric duplexer containing a dielectric filter as claimed in claim 10.

16. A communication device containing a dielectric filter as claimed in claim 10.

17. The dielectric filter as claimed in claim 10, wherein the two conductive through holes on either side of the third conductive through hole are coupled with input-output electrodes, respectively.

18. The dielectric filter as claimed in claim 10, wherein there is no electrode pattern on a surface of the open circuit end which directly connects to the conductive through holes.

* * * * *